United States Patent [19]

Gordon, Jr.

[11] 4,400,269

[45] Aug. 23, 1983

[54] GOLD PAN

[75] Inventor: Charles O. Gordon, Jr., Montclair, Calif.

[73] Assignee: Joseph W. Montigny, El Monte, Calif.

[21] Appl. No.: 265,796

[22] Filed: May 21, 1981

[51] Int. Cl.[3] ..... B03B 5/02

[52] U.S. Cl. ..... 209/447; 209/506

[58] Field of Search ..... 209/447, 506, 54, 58, 209/59, 64, 65, 206, 446, 196, 41, 485, 458; 220/94 A

[56] References Cited

U.S. PATENT DOCUMENTS

| | | | |
|---|---|---|---|
| 462,326 | 11/1891 | Paul | 209/41 |
| 481,550 | 8/1892 | Dana | 209/446 X |
| 840,333 | 1/1907 | Hussey | 209/447 |
| 1,064,854 | 6/1913 | Ord | 209/447 |
| 1,234,305 | 7/1917 | Dolten | 209/446 |
| 1,292,364 | 1/1919 | Ord | 209/447 |
| 1,948,797 | 2/1934 | Nicolai | 209/447 |
| 1,966,359 | 7/1934 | Ryan | 209/447 |
| 3,651,976 | 3/1972 | Chadbourne | 206/518 X |
| 4,164,299 | 8/1979 | Fuhr | 220/94 A |
| 4,289,241 | 9/1981 | Litrap | 209/447 |

FOREIGN PATENT DOCUMENTS

| | | | |
|---|---|---|---|
| 483815 | 4/1938 | United Kingdom | 209/506 |

*Primary Examiner*—Kathleen J. Prunner

*Attorney, Agent, or Firm*—Boniard I. Brown

[57] ABSTRACT

A gold pan comprising an elongate upwardly opening gold receptacle with a flat, finger-engaging central bottom wall, inclined end walls joined with and extending longitudinally outwardly and upwardly from the bottom wall and having upper outer transverse edges, and laterally spaced substantially vertical side walls join with and projecting upwardly from and between related edges of the bottom wall and end walls and having upper edges cooperating with the upper outer transverse edges of the end walls to define an upper rim about the pan; one side wall has an upwardly and transversely opening thumb-receiving recess in the central portion of its upper edge portion and said bottom wall has stop means defining finger-engaging surfaces at the exterior of the pan.

9 Claims, 12 Drawing Figures

GOLD PAN

This invention has to do with a gold pan and is particularly concerned with a gold pan of unique structure and imparted with novel, functional capabilities.

BACKGROUND OF THE INVENTION

For many years, prospectors and/or miners of gold have utilized large diameter, shallow, concavo convex sheet metal pans to separate gold from slurries of water and gold bearing sand. Such pans are commonly referred to as "gold pans". In use, gold pans of the character referred to above are engaged at opposite sides of their circular rims by both hands of the user. The pans, thus held, are usually dipped into the water and into the bed of a stream or other body of water being worked to dig up and hold a volume of sand and water. Thereafter, they are held substantially horizontally and are manually moved in an orbital and/or wobbling manner to cause the water and light particulate materials to flow upwardly and outwardly over the rims of the pans, so as not to cause heavier values such as gold to be carried away. The heavy values separate from the lighter materials and collect at the lower center portions of the pans where they can be conveniently collected and saved.

While the operation and use of old gold pans, as noted above, appears simple and therefore reasonably practical, the effective use of such pans requires exceptional skill which often takes extraordinary long periods of time to develop and which is unattainable by a large number of people.

Because the use of such pans requires the use of both hands, there are many people with various kinds of handicaps who cannot use them. Further, because the use of both hands is required, there are numerous places and circumstances where such pans cannot be used, because the users of the pans are not able to safely and comfortably free both hands for manipulation of the pans.

In addition to the above, old or common gold pans of the character referred to are provided in many different sizes and prudence dictates that the largest size pan a person can effectively handle be selected and used, since the volumes of material such pans can effectively handle can be said to be disproportionately little in comparison to the size of the pans.

OBJECTS AND FEATURES OF THE INVENTION

An object of this invention is to provide a novel gold pan structure which is such that it requires a minimum of skill to effectively use, which skill can often be learned and perfected by most people, in less than fifteen minutes.

Another object and feature of this invention is to provide a novel gold pan which is designed to be and which is effectively held and manipulated with one hand.

Still another object and feature of the invention is to provide a gold pan of the character referred to which is small, compact and light-weight and which is such that it can effectively and efficiently receive and work on a volume of material at a notably faster rate than a like volume of material can be worked by a common gold pan of comparable size.

Yet another object of this invention is to provide a gold pan of the character referred to above which comprises an elongate, upwardly opening unitary molded plastic container with substantially flat, vertical, laterally spaced side walls, a central, horizontal bottom wall of limited longitudinal extend and elongate, longitudinally outwardly and upwardly inclined end walls; the upper edge of at least one side wall is provided with a thumb-receiving recess and the bottom wall is provided with portions defining finger engaging surfaces to facilitate securely engaging the pan between the thumb and the fingers of one hand, for easy, convenient and non-fatiguing manual working of the pan.

It is yet another object and feature of the invention to provide a gold pan of the character referred to which further includes riffles on the end walls and value collecting recesses at the bottom wall to enhance and to simplify the separation and collection of values during use of the pan.

The foregoing and other objects and features of the invention will be fully understood from the following detailed description of typical preferred forms and applications of the invention, throughout which description reference is made to the accompanying drawing.

DESCRIPTION OF THE INVENTION

Figure 1:
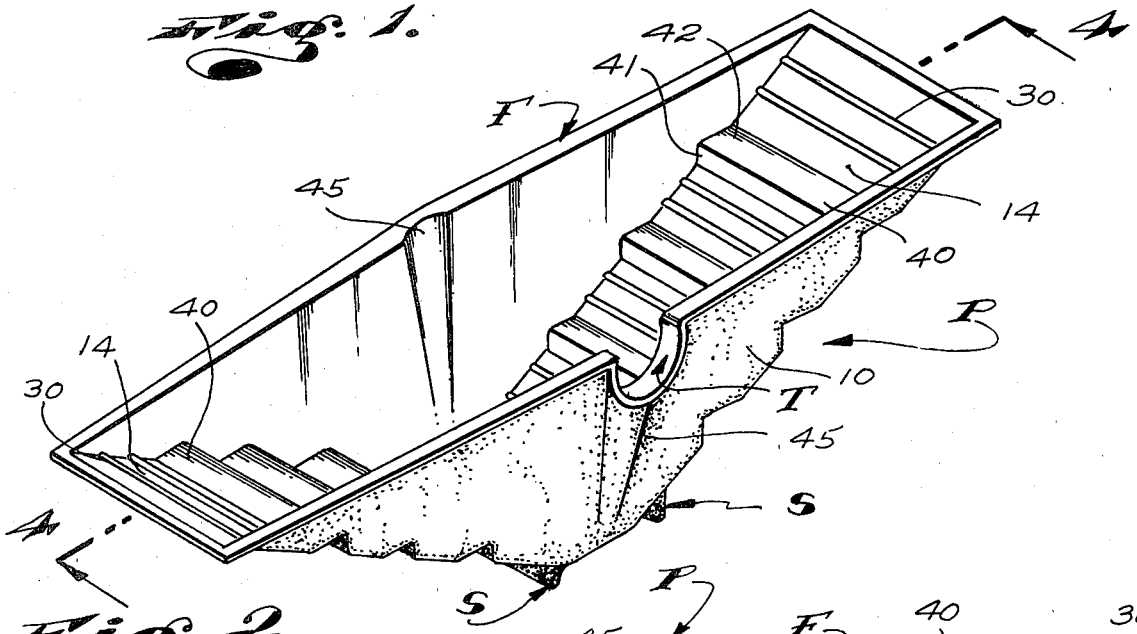
FIG. 1 is an isometric view of a pan embodying the invention.
Figure 2:
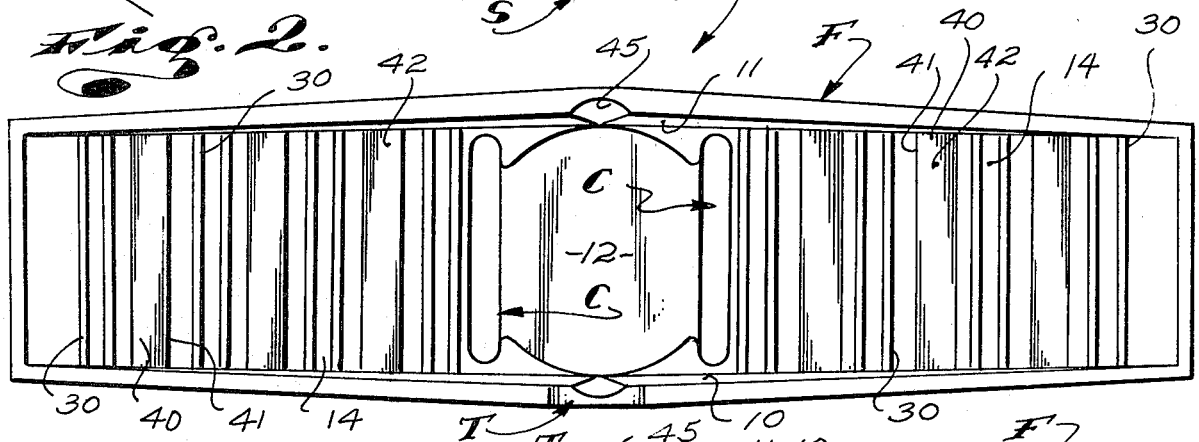
FIG. 2 is a top view of the pan.
Figure 3:
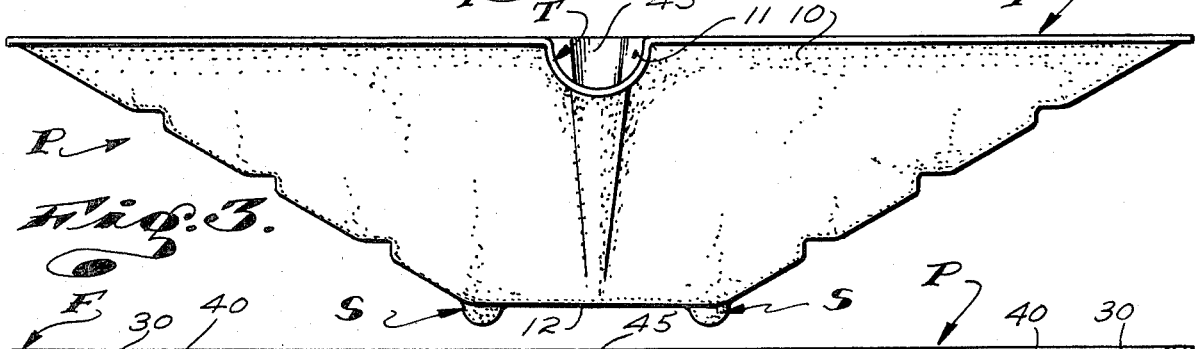
FIG. 3 is a side view of the pan.
Figure 4:
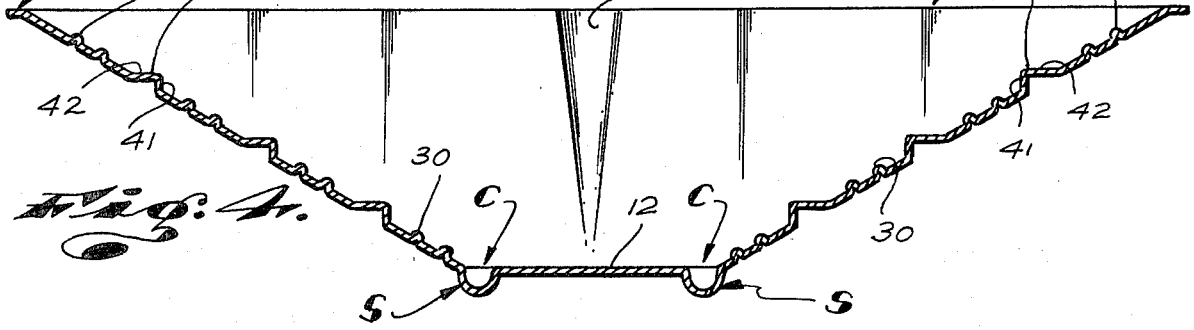
FIG. 4 is a crosssectional view taken as indicated by line 4—4 on FIG. 1.

The pan P shown in FIGS. 1 through 4 of the drawings is an elongate unitary upwardly opening vessel having longitudinally extending, laterally spaced, vertical side walls 10 and 11, a flat, horizontal, central, bottom wall 12 of limited longitudinal extent and elongate longitudinally outwardly and upwardly inclined end walls 14. The side walls 10 and 11 are inverted truncated triangular shaped walls. The bottom wall 12 is substantially flat and has opposite side edge portions which are joined integrally with the lower truncated edges of the side walls, to extend laterally therebetween, and has opposite end edge portions which join integrally with the lower inner end portions of the end walls. The upwardly and longitudinally outwardly inclined end walls, the lower inner ends of which join with the bottom wall, have opposite longitudinal side edge portions joined integrally with the upwardly and longitudinally outwardly inclined edge portions of the side walls and extend therebetween.

The upper, horizontal, longitudinally extending upper edge portions of the side walls and the upper, outer transverse end edge portions of the end walls define the rim of the vessel. In the preferred carrying out of the invention and as shown, the above noted rim defining edges of the pan are formed to establish a narrow outwardly projecting, horizontal rim flange F, which flange serves to impart desired dimensional stability into the upper open rim portion of the vessel.

The pan is from 11 to 14 inches long and is preferably 3 inches in vertical extent so that it can be conveniently engaged and securely held by one hand of the user of the pan with the thumb of that hand engaged over the rim portion of the pan intermediate the ends of one side wall thereof and with three fingers of that hand (excepting the little finger) engaged beneath the pan, in longitudinal spaced relationship with and relative to the bottom wall. At least one finger engages and extends substantially transverse the bottom wall and one or two fingers engage and extend substantially transverse the junction or junctions of the bottom wall and one or both of the end walls.

To enable engaging the bottom wall in the manner set forth above, the bottom wall can be from 2 inches to 3 inches and is preferably 2.5 inches in longitudinal extent.

The overall longitudinal extent of the pan can be varied as desired or as circumstances require. In practice, it has been determined that a good and satisfactory overall length for the pan is about 12 inches.

When the maximum vertical extent of the pan is about 3 inches, the bottom wall is about 2.5 inches and the overall length of the pan is about 12 inches, the angle of the end walls (from horizontal) is about 30°; which angle has been found to be a good and satisfactory angle for effective and efficient operation of the pan.

The pan can vary widely in lateral extent. For convenient visual inspection and lighting of the interior of the pan and to afford convenient manual access to the interior thereof, the pan is preferably no less than $2\frac{1}{2}$ inches wide. The pan should not be so wide as to unduly increase its capacity and thereby create excessive loads and forces on a user's hand, wrist and arm, when in use. It has been determined that the pan is preferably between 3 and 4 inches wide.

Larger devices embodying the invention which are from 5 to 6 inches wide; have been made and satisfactorily operated by persons with strong hands, wrists and arms. However, those persons who have used such oversized pans have found that the added work energy expended in using them is not justified by the benefits attained by their increased size.

In use, the pan P is engaged in the user's hand in the manner set forth above and it is filled with a slurry of water and values bearing sand, as by manually dredging the sand from the bed of a creek or other body of water, with the pan itself.

Thereafter, with the pan held substantially upright it is manually rocked, longitudinally, back and forth to cause the heavy materials to separate and drop down in the pan (via specific gravity displacement) and, at the same time, cause water and the light waste materials or gangue to wash and flush back and forth in the opposite end portions of the pan and to spill from the opposite ends thereof.

The weight of the pan, when filled in the manner set forth, can be substantial and when it is manually rocked and worked in the manner noted, the inertial forces encountered can be substantial. The above noted weight and inertial forces are sufficient so that substantial physical strength and energy is required to maintain a grip on and with the pan, particularly when it is wet. In the absence of some suitable means to enhance one's grip on the pan, the energy expended in using it is such that the fittest and strongest of men are soon fatigued and find it necessary to rest and recuperate after use of the pan for several minutes.

In accordance with the above, the pan of this invention is provided with a central, upwardly opening, thumb-receiving recess T in the upper rim portion of at least one side wall and in which the thumb of the user is seated and held against longitudinal shifting relative to and/or along the upper edge of that wall. Further, the recess T can and is preferably made sufficiently deep or great in vertical extent to reduce the effective vertical extent of the pan where the thumb is to occur and so that the lower portion of the recess T or that portion of the side wall defining the recess T can be effectively hooked and retained by the user's thumb upon his slight bending or breaking of the joint of the thumb.

In furtherance of the above, the bottom of the pan is provided with at least one and preferably a pair of longitudinally spaced downwardly projecting, transversely extending finger-engaging stops S against which one or more of the fingers of the user's hand engage and stop; thereby preventing longitudinal slipping and displacement of the fingers relative to the bottom of the pan, as it is rocked back and forth.

With the above noted recess T and stop means S, the pan P can be effectively worked in the manner noted above without requiring great strength and with the expenditure of minimal, non-fatiguing energy. With the recess and stop means noted above, the pan is effectively locked and held in the user's hand by his setting his hand in position where his thumb and fingers engage the recess T and stops S and where not appreciable forcible gripping of the pan is required.

It has been determined that the stop or stops S are preferably positioned to occur at the junctions between the bottom wall 12 and the end walls 14. When thus positioned, one of the stops, in most instances, occurs between and is engaged by a finger engaging the bottom wall and a finger engaging the lower inner end of a related end wall. This is due to the inherent geometry of the human hand and the tendency of the fingers to engage the pan at a junction of the bottom wall and an end wall, when the pan is engaged in a most comfortable and natural manner.

When the pan is engaged in one's right hand, his fingers tend to be at the right of his thumb and they most naturally engage the junction of the right hand end of the bottom wall and the end wall related to it and tend to occur at opposite sides of the stop S at that junction. When the pan is engaged in one's left hand, his fingers tend to be to the left of his thumb and they tend to engage the junction of the left end of the bottom wall and its related end wall and occur at opposite sides of the stop S at that junction.

In the form of my invention shown in FIGS. 1 through 4 of the drawings, the stop means are elongate, transversely extending, ribs or bar-like projections depending from and in effect define the junctions between the bottom wall and its related end walls.

In addition to the above, the projections defining the stop means S define a pair of longitudinally spaced transversely extending value collecting recesses or channels C at and occurring across the opposite ends of the bottom wall 12 and opening upwardly into the interior of the pan.

While the stops S and channels C are shown directly related to each other, they are in fact functionally unrelated. The apparent co-relationship of the stops and channels is attributable to effect design.

In use, the channels C serve to collect the heaviest materials and metal values which drop from the slurry in the pan, as the slurry flushes and surges and is thereby worked within the pan.

In addition to the foregoing, the upwardly and inwardly disposed upper surfaces of the end walls 14 are provided with a plurality of longitudinally spaced transversely extending bead-like riffles 30 and/or a plurality of longitudinally spaced, transversely extending steps 40. The riffles and/or steps serve to impede or stop the longitudinal outward flushing and/or movement of heavy particulate materials and values that have dropped from the surging slurry in the end portions of the pan and cause or induce those heavy materials and values to move longitudinally inwardly and downwardly across the surfaces of the end walls, to the bottom wall, where they are free to move and collect in the channels C. The steps 40 are formed with longitudinally inwardly disposed vertical risers 41 and horizontal tread portions 42 so that material moves substantially freely longitudinally inwardly relative to the end walls and is effectively stopped or prevented from moving longitudinally outwardly relative thereto.

The small bead-like riffles are more effective to stop and collect certain fine sands and values which must be worked and washed with a gentle surging motion; while the large steps are most effective to quickly work coarse sands and the like. By the provision of both the riffles and the steps, it is possible to initially quickly wash the greater portion of the waste materials from the pan by vigorous motion and to thereafter slow the motion and work the remaining sands more gently to collect the finer values carried thereby.

In FIGS. 7 through 12 of the drawings, we have shown several other and/or different forms of riffles, steps and channels that can be provided on or in the upper surfaces off the end walls, without departing from the broader aspects and spirit of the invention.

Figure 7:
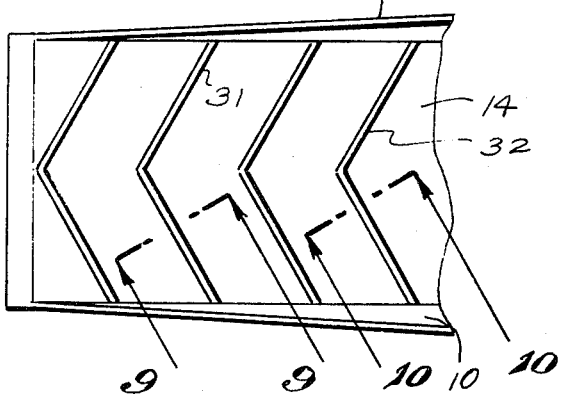
FIG. 7 is a top view of a portion of a pan with different forms of riffles.
Figure 8:
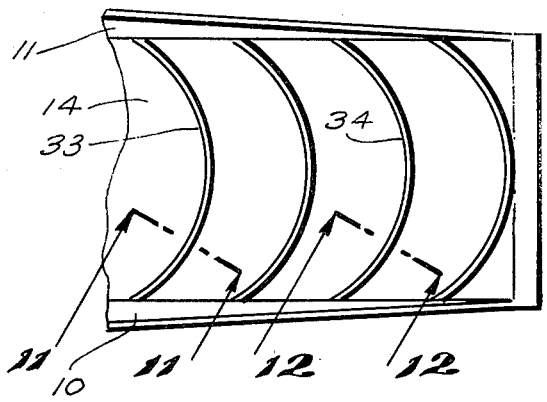
FIG. 8 is a view similar to FIG. 7 showing other forms of riffles.
Figure 9:
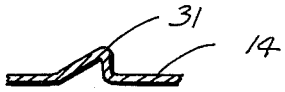
FIGS. 9 and 10 are enlarged detailed sectional views taken as indicated by lines 9—9 and 10—10 on FIG. 7.
Figure 11:
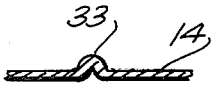
FIGS. 11 and 12 are enlarged detailed sectional views taken as indicated by lines 11—11 and 12—12 on FIG. 8.
Figure 10:
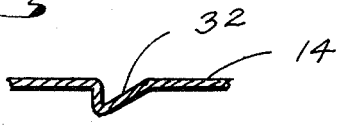
Figure 12:
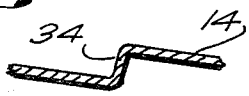

In FIGS. 7, 9 and 10, a combination of longitudinally spaced V-shaped riffles 31 and V-shaped channels 32, in chevron-like form and arrangement, are illustrated. In FIGS. 8, 11 and 12, longitudinally spaced radiused or arcuate bead-like riffles 33 and step-like risers 34 are shown. It will be apparent that any one or a combination of the above forms of riffles, steps and/or channels will, when incorporated in the pan that we provide, attain beneficial end results.

Finally, the side walls 10 and 11 of the pan P, as shown, are formed and provided with central vertical troughs 45 to facilitate the effective pouring and transfer of values collected at the bottom of the pan into a small flask or other container provided to collect and keep such values.

Figure 5:
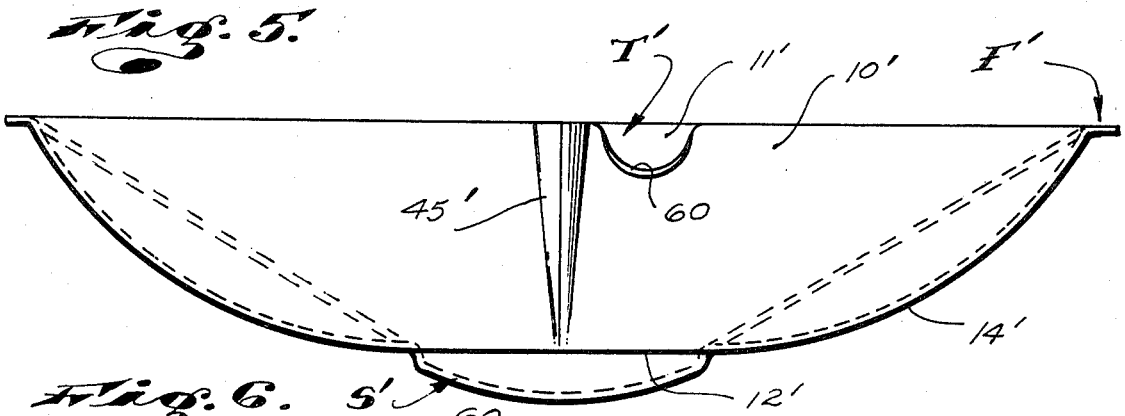
FIG. 5 is a side view of another form of pan.
Figure 6:
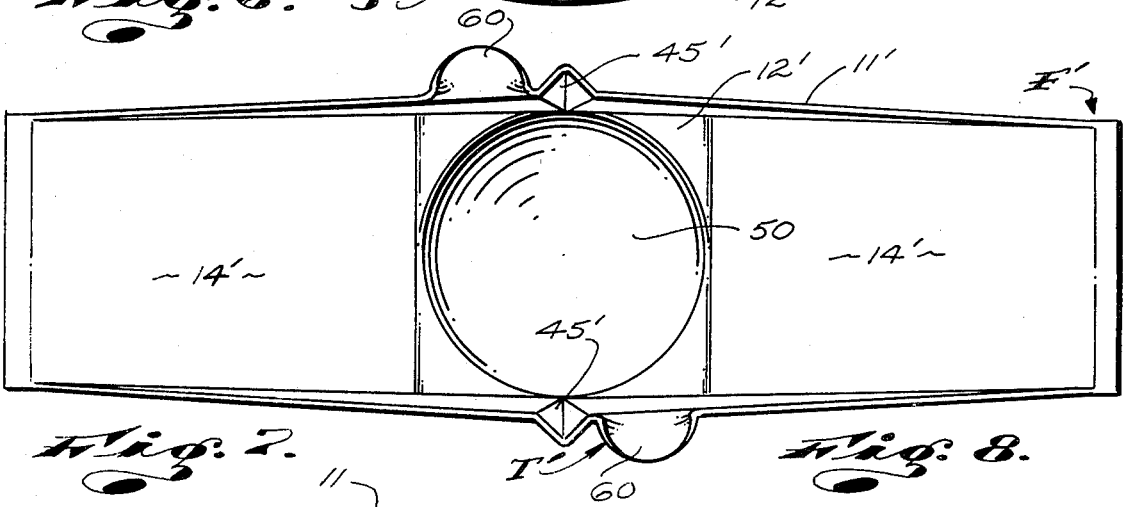
FIG. 6 is a top view of the pan shown in FIG. 5.

In FIGS. 5 and 6 of the drawings, another form of pan P', embodying the invention, is illustrated. In this form of the invention, the bottom wall 12' is provided with a concave central concentrate collecting recess 50 and a convex finger-engaging stop or protruberance S', on and about which the user's fingers can be conveniently engaged and set.

The end walls 14' of the pan P' are curved longitudinally outwardly and upwardly and are shown plain or without riffles and the like. It is to be understood that the end walls 14' can, in accordance with this invention, be provided with any one or more of the different forms of riffles and the like illustrated and described above.

Still further, if desired, the walls 14' can be straight, as shown in dotted lines.

In the form of the invention now under consideration, thumb recesses T' are provided in each side wall 10' and 11' and are offset longitudinally. The recesses T' are established by forming the side walls down and out to provide the recesses with broad finger-engaging pads 60.

Longitudinally offsetting the recesses T' in the manner shown is necessary or desired since the finger-engaging protruberance S' at the bottom wall 12' is centrally located and is such that the user's fingers tend to engage about that protruberance and to support the pan centrally of the bottom wall. Accordingly, due to the geometry of the human hand and the manner in which the pan P' is engaged, its recesses T' must be offset substantially as shown to afford comfortable and relaxed engagement of the pan.

In this form of the invention, the rim portion of the side walls 10' and 11' have no flanges and the upper outer edges of the end walls 14' have flanges F'.

The side walls 10' and 11' are provided with discharge troughs 45' similar to the troughs 45 in the first form of the invention.

It is to be understood and it will be readily noted that the several distinguishing features shown throughout the drawings are interchangeable and are such that they can be selected and combined in any desired manner in carrying out the invention. Further, the several different features illustrated do not include all changes and/or modifications that might be made, but are intended to illustrate and make clear the fact that changes can be made without departing from the broader aspects of the invention.

While the gold pan P that we provide, in any of its possible forms, can be made of different materials and can be formed or fabricated in many different ways. It is preferred that it be vacuum formed of durable, flexible and resilient sheet plastic and that it be formed of a black, opaque plastic, which provides an effective background or field for visually examining materials collected in the pan and against which light colored, bright metal values can be seen in sharp visual contrast.

It will be noted that vacuum forming or molding of the gold pan requires that the side walls of the pan be inclined upwardly and outwardly relative to each other to provide necessary draft, as clearly shown in the drawings.

It will be apparent from the foregoing that the pan that we provide is inherently a very easy and economical to make structure which can be easily and conveniently marketed and sold at little cost. Further, it will be apparent that the pan that we provide is inherently such that it will effectively separate and collect heavy gold and other metal values from a slurry of water and values bearing sand, upon being worked and/or manipulated in the manner described in the foregoing.

Having described only typical preferred forms and applications of our invention, we do not wish to be limited to the specific details herein set forth, but wish to reserve to ourselves any modifications and/or variations that may appear to those skilled in the art and which fall within the scope of the following claims:

Having described our invention, I claim:

1. An elongate, upwardly opening gold pan for use with water to displace lighter waste materials from heavier desired material of a mix of granular materials placed therein comprising:

a normally horizontal, central bottom wall with interior and exterior surfaces, opposite side edges, opposite end edges, and transverse channels, said transverse channels being positioned in said interior surface adjacent said opposite end edges for collecting the heavier desired material;

inclined end walls joined with and extending longitudinally outwardly and upwardly from said end edges of said bottom wall at an angle therebetween, said inclined end walls having side edges, upper outer transverse end edges, and spaced transversely extending, turbulence creating ribs extending therefrom; and laterally spaced substantially vertical side walls joined with and projecting upwardly from and between said side edges of said bottom wall and said end walls.

2. The gold pan set forth in claim 1 wherein at least one of said side walls has an upper edge portion with an upwardly and transversely opening thumb-receiving recess defined therein opposite said bottom wall.

3. The gold pan set forth in claim 2 wherein said bottom wall has:

stop means, said stop means including:

an elongate transversely extending downwardly projecting protruberance at the junction between one end edge of said bottom wall and its joined end wall defining a finger-engaging surface portion of said exterior surface of said bottom wall.

4. The gold pan set forth in claim 2 wherein said bottom wall has:

stop means, said stop means including:

downwardly projecting elongate transversely extending protruberances at the junctions between said end edges of said bottom wall and their joined end walls opposite said transverse channels defining finger-engaging surface portions of said exterior surface of said bottom wall.

5. The gold pan set forth in claim 2 wherein said bottom wall has:

stop means, said stop means including:

downwardly projecting protruberances formed as portions of said exterior surface of said bottom wall which also form said transverse channels in said interior surface.

6. The gold pan set forth in claim 1 wherein said inclined end walls extend longitudinally outwardly and upwardly from said end edges of said bottom wall at an angle of about 30°.

7. The gold pan set forth in claim 1 wherein said laterally spaced substantially vertical side walls have upper edges cooperating with said upper outer end edges of said end walls to define an upper rim about said pan.

8. The gold pan set forth in claim 7 wherein at least one of said laterally spaced substantially vertical side walls has a trough therein which extends upwardly from said bottom wall to said upper edge of said at least one vertical side wall.

9. The gold pan set forth in claim 7 wherein at least one of said laterally spaced substantially vertical side walls has:

an upper edge with an upwardly and transversely opening thumb-receiving recess defined therein; and a trough defined in said at least one of said laterally spaced substantially vertical side walls, said trough extending upwardly from said bottom wall to said upper edge at said thumb-receiving recess.

* * * * *